US005203130A

United States Patent [19]

Freelove

[11] Patent Number: 5,203,130

[45] Date of Patent: Apr. 20, 1993

[54] DOOR FRAME SHIELD

[76] Inventor: James W. Freelove, 13903 Roseton Ave., Norwalk, Calif. 90650

[21] Appl. No.: 799,424

[22] Filed: Nov. 26, 1991

[51] Int. Cl.[5] ..... E04B 1/04

[52] U.S. Cl. ..... 52/211; 52/288; 52/717.01

[58] Field of Search ..... 52/211, 213, 214, 215, 52/217, 287, 288, 717.01, 775

[56] References Cited

U.S. PATENT DOCUMENTS

| | | | |
|---|---|---|---|
| 1,620,933 | 3/1927 | Wilcox | 52/717.01 |
| 2,837,787 | 6/1958 | Wright | 52/717.01 |
| 3,130,455 | 4/1964 | Borlenghi | 52/211 X |
| 3,559,356 | 2/1971 | Kora . | |
| 3,591,985 | 7/1971 | Coppins . | |
| 3,918,228 | 11/1985 | LaBorde | 52/717.01 X |
| 3,974,606 | 8/1976 | LaBorde | 52/288 |
| 4,012,878 | 3/1977 | Ellingson . | |
| 4,223,494 | 9/1980 | Wendt | 52/211 |
| 4,242,848 | 6/1981 | Schultz . | |
| 4,281,480 | 8/1981 | Wendt | 52/211 X |
| 4,527,369 | 7/1985 | Adams . | |
| 4,682,451 | 7/1987 | Hubble | 52/717.01 X |
| 4,720,050 | 10/1987 | Giguere | 52/775 X |
| 4,768,320 | 9/1988 | Weller . | |
| 4,875,318 | 10/1989 | MacLeod et al. | 52/211 |

FOREIGN PATENT DOCUMENTS 2416390 11/1974 Fed. Rep. of Germany ..... 52/211

OTHER PUBLICATIONS

Campbell Corporation-undated (current) Mfgs. 20 pages Polychvome Publication—see pp. 12 and 13.

*Primary Examiner*—Richard E. Chilcot, Jr.
*Attorney, Agent, or Firm*—Georges A. Maxwell

[57] ABSTRACT

A door frame shield to extend about and longitudinally of the inside surfaces and the front and rear edges of a jamb and door stop and outwardly about the front and rear casings of a related door frame structure. The shield includes elongate front and rear inside sections of extruded plastic to engage about and extend longitudinally of the jamb and door stop; and, elongate retainer parts of extruded plastic to engage about and extend longitudinally of the front and rear casings of a related door frame structure. The front and rear inside sections and the front and rear retainer parts are connected together by longitudinally extending fastener devices that allow for the sections and parts to be moved into tight substantially conforming engagement with and about the jamb, door stop and casings with which the shield is related.

9 Claims, 3 Drawing Sheets

DOOR FRAME SHIELD

BACKGROUND OF THE INVENTION

Ordinary domestic and commercial building structures are divided into rooms (including hallways, closets, and the like) by walls. The walls are provided with doorways to allow for free movement or travel into and out of the buildings and from room to room within the buildings. The doorways are defined by door frame structures that are most commonly established of wood, though metal door frame structures are not uncommon.

The ordinary door frame structure includes laterally spaced vertical jambs and a horizontal header with flat inside surfaces and front and rear edges; stops fixed to and projecting inwardly from the inside surfaces of the jambs and header (between the front and rear edges thereof) and casings (mouldings) fixed to the front and rear edges of and projecting outwardly from the jambs and headers. The jambs of such door frame structures are commonly fastened to laterally spaced vertical studs that define a roughed-in door opening within a related wall structure. The jambs, together with their related header, are set within the roughed-in door opening with their front and rear edges flush with their related front and rear surfaces of the wall structure. The stops are, for example, set forward from the rear edges of the jambs and header a distance equal to the thickness of a door that is hingedly mounted or hung on one of the jambs. The casings are elongate strips of moulding with inside edge portions that are fixed to the inside and outside edges of the jambs and header. The casings bridge between the jambs and header and the wall structure and overlie the edge portions of the front and rear surfaces of the wall that occur about the jambs and headers.

Today's standard wall structures vary from $5\frac{1}{4}''$ and $4\frac{1}{4}''$ in thickness. Accordingly, standard jambs and headers vary between $5\frac{1}{4}''$ and $4\frac{1}{4}''$ in width. In the case of wood door frame structures, the jambs and headers are made of $\frac{1}{2}''$-thick lumber.

Standard door stops are made of $1\frac{1}{4}'' \times \frac{3}{8}''$ moulding and are disposed to define $1\frac{1}{4}''$ wide inside surfaces and $\frac{3}{8}''$ wide front and rear edges.

Standard exterior and solid wood doors are $1\frac{3}{4}''$ thick while standard interior and hollow-core doors are $1\frac{3}{8}''$ thick. Doors are commonly mounted within their related door frames with their rear surfaces flush with the rear edges of the jambs and headers and with their front surfaces in close to stopped engagement with their related door stops. Accordingly, where $1\frac{3}{4}''$-thick doors are used the rear edges of the stops are spaced slightly more than $1\frac{3}{4}''$ from the rear edges of the jambs and headers. Where $1\frac{3}{8}''$-thick doors are used, the rear edges of the stops are spaced slightly more than $1\frac{3}{8}''$ from the rear edges of the jambs and header.

The standard spacing between the inside surfaces of the jambs and header of a door frame and their opposing edges of a related door is from 3/32" to 4/32" ($\frac{1}{8}''$).

Standard door frame casings vary from $\frac{5}{8}''$ to $\frac{3}{8}''$ thick and from $1\frac{1}{4}''$ to 6" wide. Casings are normally nailed or otherwise fixed to their related edges of the jambs and headers with their inside edges spaced or set back from the inside surfaces of the jambs and headers a distance between $\frac{1}{8}''$ and $\frac{1}{4}''$. The noted set-back is provided to accommodate the pinned portions of the hinges used to hang the doors.

In accordance with the above, it will be apparent that the term "standard" as applied to door frames defines a rather standard door frame structure certain dimensions of which are subject to limited though notable variations.

A major problem confronted by those who own and/or maintain buildings is the tendency for door frames within their buildings to become marred, damaged and oftentimes mutilated as a result of being impacted, scraped and/or abraded by various objects that are moved or transported through the door openings during ordinary use of the buildings.

In those cases where invalids who must transport themselves in wheelchairs are encountered, it is often extremely difficult for those persons to maneuver their chairs through the doorways of buildings without various parts and/or portions of the chairs impacting and dragging on and across the door frames and doing serious damage thereto. The same is also true in the case of those who, in the course of doing business and the like, move wheeled carts and equipment from room to room in the buildings they occupy.

Those property owners who are restricted to wheelchairs and the like, as well as those whose activities include the frequent or regular movement of equipment about their properties, are equally concerned about the damage that is likely to be caused to their buildings, including the door frames, by their wheelchairs and/or equipment.

As a result of the above, there are those in the prior art who have long sought to provide guards or shields for door frames that might effectively protect the frames against damage by wheelchairs, equipment and the like impacting upon them.

The most common and familiar door frame guards provided by the prior art are simple L-shaped strips of extruded plastic or rubber that are engaged over the outside corner edges of the frames and fixed thereto as by tacks or nails. Such guard strips are highly subject to being caught and displaced by equipment and the like that is moved into engagement therewith and are therefore of questionable utility. They are a nuisance to maintain. Further, the need to nail them in place is highly undesirable since the driving of nails into door frames causes damage thereto and the use of nails in and about doorways, if not "set in," creates serious hazards.

The use of adhesives to hold door frame guards in place has been tried and found to be unsatisfactory since they prevent the guards from being removed from the door frames without damaging the frames or so despoil the surfaces of the door frames that they must be fully refinished or replaced.

Others in the art have provided more extensive door frame guards that are in the nature of elongate channel sections that extend about the front inside and rear surfaces of their related door frame structures in close conformed relationship therewith. These door frame guards are only satisfactory and effective when related to those specific door frame structures for which they are especially designed. They cannot be satisfactorily related to a door frame structure wherein one dimension is notably different from the corresponding dimension of the door frame structure for which they are designed. As a result of the above, such door frame guards or shields have proven to be impractical for commercial exploitation and have met with little or no commercial success.

In accordance with the above, there has been a long-felt need for an effective door frame guard structure that guards the front, inside and rear edges and/or surfaces of a door frame structure and that is such that it can be effectively related to different sizes, makes and models of standard door frame structures wherein uniform standard dimensions are reasonably closely adhered to.

OBJECTS AND FEATURES OF THE INVENTION

It is an object of the present invention to provide an improved door frame shield that can be easily, quickly and advantageously engaged on and with the great majority of different sizes of standard door frame structures.

It is an object and feature of the invention to provide an improved door frame shield of the general character referred above that includes an elongate sectional inside subassembly to conform with and overlie the inside surfaces and the front and rear edges of a related door frame defined by a jamb and door stop; the sections of said subassembly being movable laterally (forwardly and rearwardly) relative to each other so the subassembly can be made to cooperatively engage related jamb and door stop assemblies of different fore and aft depths.

It is another object and feature of the present invention to provide an improved door frame shield of the general character referred to above wherein the inside subassembly includes an elongate rear section with a longitudinally extending inwardly projecting and outwardly opening channel part to cooperatively receive and overlie a related door stop, a rear web part that extends rearwardly from the channel part adjacent the inside surface of a related jamb and then outwardly to a related rear casing, and a rear gripper part with an outwardly opening slot on the web adjacent the rear casing and an inner gripper part projecting forward from the channel part and having a forwardly opening slot with at least one longitudinally serrated surface; and, a front section with a flat longitudinally extending tongue part, with at least one longitudinally serrated surface, entered into the slot of the inner gripper part and projecting forwardly therefrom to overlie the inner inside surface of the jamb, a flexible forwardly and outwardly turned front web part extending from the tongue to a related front casing, and, a front gripper part on the front web part adjacent to said front casing and having an outwardly opening slot, with at least one longitudinally serrated surface; and, elongate front and rear retainers with inner tongues, each having least one longitudinally serrated surface, engaged in the outwardly opening slots in the front and rear gripper parts and having outer cleats that overlie and establish stopped engagement with outside edges of their related front and rear casings.

Yet another object and feature of the present invention is to provide an improved door frame shield of the general character referred to above wherein the longitudinal serrations on surfaces of the gripper and tongue parts are in the form of teeth that ride laterally over each other when the tongues are entered into the slots in the gripper parts and that interengage and prevent the tongues from moving out of engagement in the gripper parts in a direction normal to the longitudinal axes of the serrations, while allowing the tongues to be slidably moved out of engagement with the gripper parts in directions parallel with the longitudinal axes of the serrations.

The above and other objects and features of the invention will be apparent and will be fully understood from the following detailed description of one preferred form and embodiment of the invention throughout which description reference is made to the accompanying drawings.

DETAILED DESCRIPTION OF THE INVENTION

Figure 1:
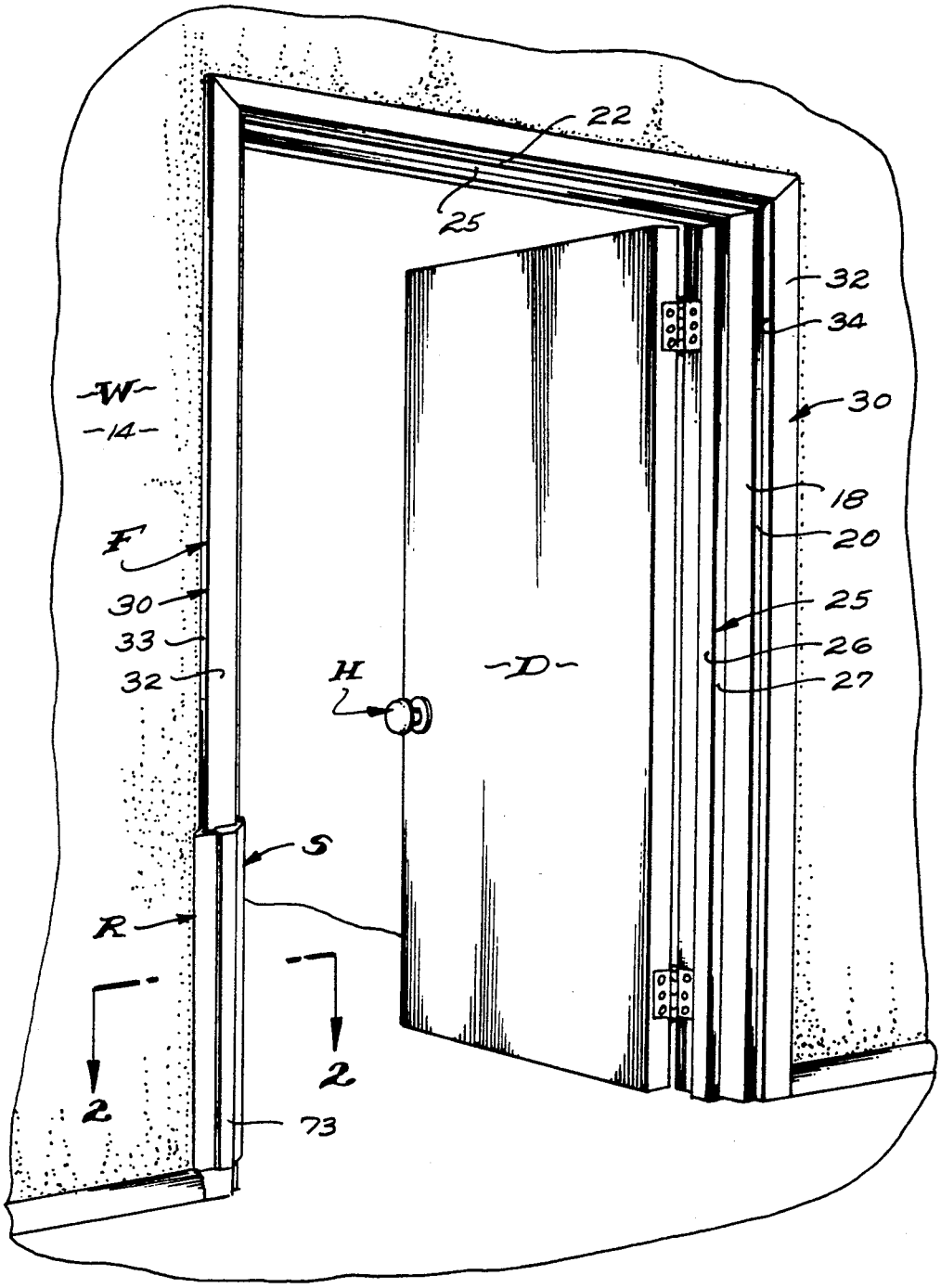
FIG. 1 is a perspective view of a door frame with my new door frame shield related to it.

In the drawings, I have shown my improved door frame shield related to a standard door frame structure F. The door frame structure F is shown mounted within a standard will structure W.

The frame structure F is mounted within a roughed-in door opening in the wall structure W. The roughed-in door opening is, in accordance with common practices, defined by a pair of laterally spaced vertical framing studs 10 (one of which is illustrated) and a horizontal framing header (not shown) that extends between the studs and defines the top of the roughed-in door opening.

The wall structure has flat front and rear surfaces 14 and 15 that are, in the case illustrated, established by layers of lathe and plaster 16 and 16'. The overall thickness of the wall between its front and rear surfaces 14 and 15 is, for example, 5¼".

The door frame F includes a pair of laterally spaced, flat, vertical jambs 17 and 18 that are equal in width (5¼") with the thickness of the wall. The jambs are fixed to the studs 10 as by means of nails (not shown).

In practice, the roughed-in opening in the wall defined by the framing studs and header is sometimes made slightly larger than the dimensions of the door frame and the door frame is properly oriented within the roughed-in opening by means of shims engaged between the jambs and the studs.

The jambs 17 and 18 of the frame are, for example, ½" thick, and have flat inside surfaces 19 that define a finished door opening. The jambs also have flat longitudinally extending front and rear edges 20 and 21 that are flush with the front and rear surfaces of the wall.

The frame F next includes a header 22 that is made of the same stock as the jambs and that is fixed to and extends between the upper ends of the jambs. The header 22 has surfaces and edges similar to the surfaces and edges of the jambs.

The frame F next includes door stops 25 that are fixed to and extend longitudinally of the inside surfaces 19 of the jambs and the header. The stops 25 are made of standard 1¼"×⅜" wood moulding strips and have or define flat inside surfaces 26 and flat front and rear edges 27 and 28 within the frame structure. The stops are nailed or otherwise fixed to the jambs and header with their rear edges 28 spaced from the rear edge 21 of the jambs and the header a distance equal to the thickness of a door D that is hingedly mounted within the frame F plus approximately 3/32".

The door D is hingedly mounted on the jamb 19 that defines what is commonly referred to as the closed side of the door frame. The other jamb 19 of the frame occurs at what is referred to as the open side of the door frame. The door D is mounted to occur within the frame rearward of the door stops, when closed, and to swing or pivot rearwardly when opened to an open position such as is shown in FIG. 1 of the drawings.

The frame F next and finally includes front and rear casings 30 and 31 that are nailed or otherwise fixed to the front and rear edges of the jambs 17 and header 22. The casing projects outwardly from the jambs and header to bridge across the lines of joinder between the frame and the roughed-in door opening in the wall W and to establish flat opposing engagement with the edge portions of the front and rear surfaces of the wall, about the door frame structure.

In the case illustrated, the front casing is established of $\frac{5}{8}$"-thick and $2\frac{1}{4}$"-wide moulding and the rear casing is established of $\frac{1}{2}$"-thick and $2\frac{1}{4}$"-wide moulding. The front casing has a flat front surface 32, a straight outside edge 33 that is normal to the front surface of the wall, and an inner edge 34 that is shown as being generously radiused. The rear casing has a flat rear surface 35, a straight flat outer edge 36 that is normal to the rear surface of the wall, and a generously radiused inside edge 37.

Figure 2:
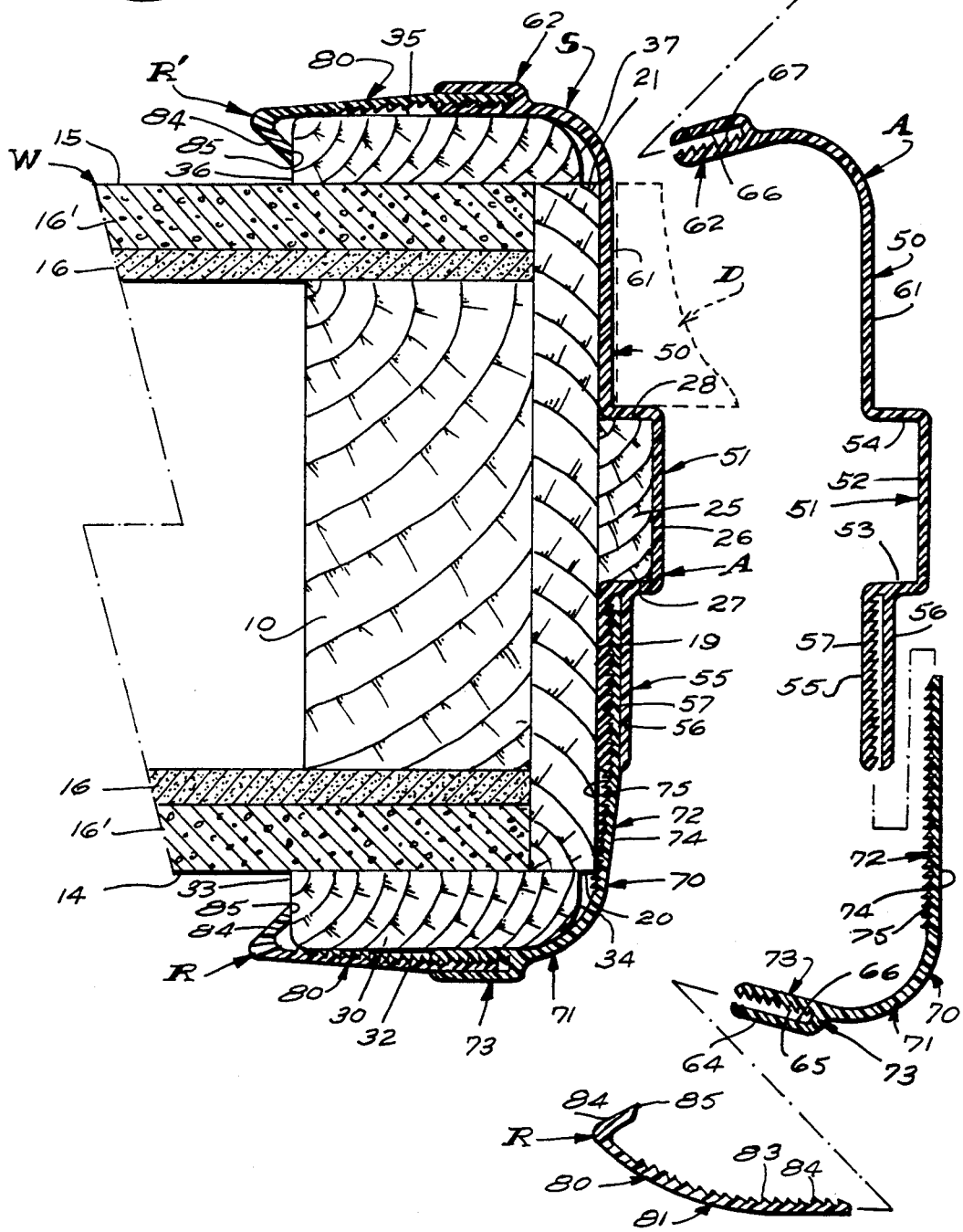
FIG. 2 is an enlarged detailed sectional view taken as indicated by Line 2—2 FIG. 1.
Figure 4:
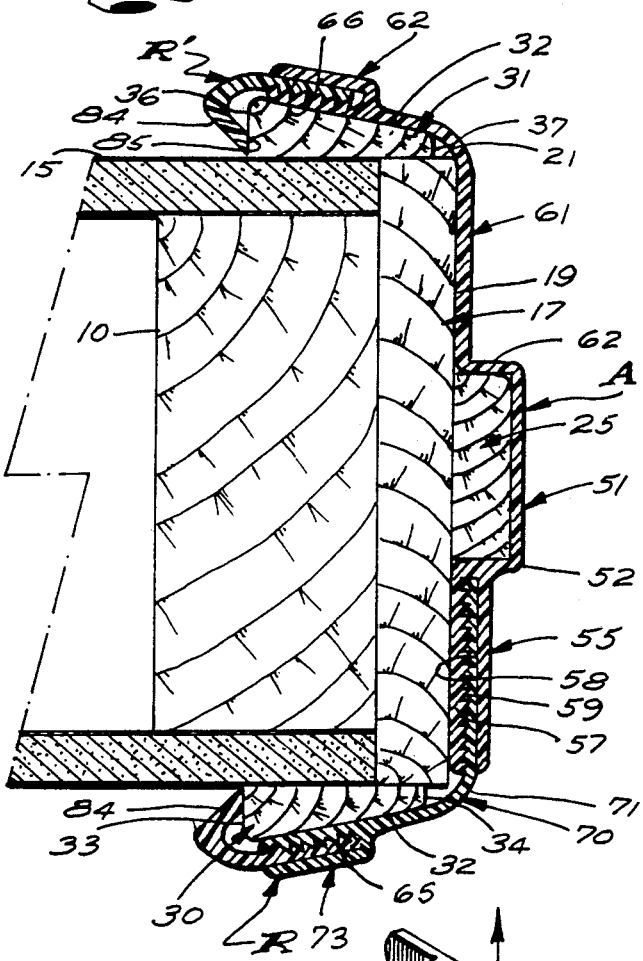
FIG. 4 is a view similar to FIG. 2 showing the door frame shield related to a door frame having different dimensions than the door frame shown in FIG. 2.

It is to be noted that the $5\frac{1}{4}$"-thick wall structure shown in FIG. 2 of the drawings is the thickest of today's standard wall structures. For comparison purposes, in FIG. 4 of the drawings I have shown my new door frame shield related to a $4\frac{1}{4}$"-thick wall which is today's thinnest standard wall thickness.

Figure 6:
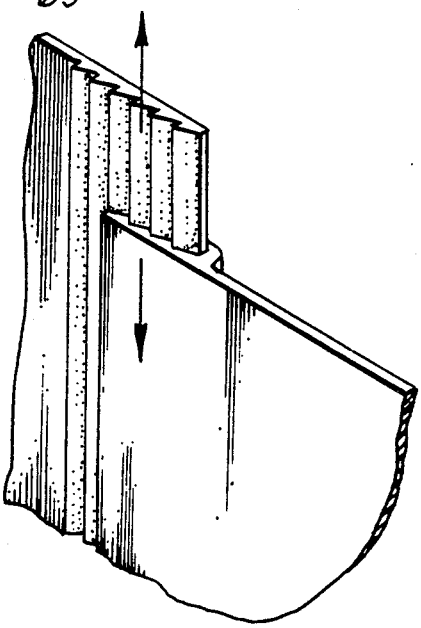

In FIG. 1 of the drawings, the door D is a $1\frac{3}{4}$"-thick door, which is the thickest standard door. In FIG. 6 of the drawings, the door frame structure is made to accommodate a $1\frac{3}{8}$"-thick door, which is the thinnest standard door.

Standard door casings vary from $\frac{3}{8}$" thick and $1\frac{1}{4}$" wide to 1" thick and $5\frac{1}{4}$" wide. While the outer edges and inside wall opposing surfaces of standard casings are straight and flat, the outer or exposed surfaces and inner edges thereof are often milled or otherwise decoratively formed for aesthetic purposes.

In practice, it is not uncommon that the front and rear casings about door frames are dissimilar in size and shape.

The improved door frame shield S of the present invention is particularly suited to be related to a portion of a standard door frame structure that is sought to be protected from damage upon being contacted by objects, such as wheelchairs, office equipment and the like, that are regularly moved through the door opening defined by the frame.

Under normal circumstances, that portion of the door frame that is likely to be damaged is the lower portion of the jamb, stop and casings that occur below the door handle H and bolt plate (not shown) that occur at the open side of the door and frame. The open side of the door frame is that side of the frame towards which one tends to move objects toward when passing them through the door opening.

In accordance with the above, I have elected to show the shield related to the above-noted portion of the door frame F and not to the other portions of the frame. It will be apparent that the door frame shield can be related to the entire inside perimeter of the door opening or to any portions thereof as desired or as circumstances might require.

The shield S includes an inner subassembly A and two like retainers R and R'.

The inner assembly A includes an elongate vertically extending rear section 50 and an elongate vertically extending front section 70. The rear section includes a central vertically extending inwardly projecting and outwardly opening channel part 51 with an inside wall 52 and front and rear edge walls 53 and 54 that oppose and establish flat supported engagement with the inside surface 26 and the front and rear edges 27 and 28 of the door stop 25 with which the shield is related.

The section 50 next includes an elongate vertically extending inner gripper part 55 that projects forwardly from the front wall 53 of the channel part 52 and that occurs in close supported engagement with the inside surface of the jamb forward of the door stop 25. The gripper part 55 has flat inside and outside walls 56 and 57 that project freely forwardly from the front wall 52 of the channel part to establish an elongate longitudinally extending forwardly and axially or longitudinally opening slot with inwardly and outwardly disposed opposing surfaces 58 and 59. In the form of the invention illustrated, the outwardly disposed surface 59 in the gripper part 55 is formed with longitudinal serrations. That is, it is formed with a multiplicity of longitudinally extending parallel teeth 60. The teeth 60 of the serrated surface have forwardly and inwardly inclined ramp surfaces and rearwardly disposed stop surfaces that are substantially normal to the plane of the wall 57.

The section 50 next includes an elongate longitudinally extending rear web part 61 that projects rearwardly from the rear wall 54 of the channel part 51 to occur in flat supported engagement with the inside surface 19 of the jamb 17 rearward of the stop 25 and that projects rearwardly and thence outwardly from the jamb to terminate adjacent the rear casing 31 of the door frame structure.

Finally, the part 50 includes an elongate longitudinally extending rear gripper part 62 which is similar in detail to the inner gripper part 55. The gripper part 62 has front and rear walls 63 and 64 with spaced opposing surfaces 65 and 66 defining an outwardly and longitudinally opening slot. The surface 65 of the wall 63 is formed with longitudinal serrations or teeth 67 with inwardly and forwardly inclined ramp surfaces and stop surfaces that are normal to the plane of the wall 63.

The wall 63 of the rear gripper part is preferably an extension of the web part 61 of the section 50 and establishes flat supported bearing engagement with the rear surface of the rear casing 31 of the frame, as clearly illustrated in the drawings.

Figure 3:
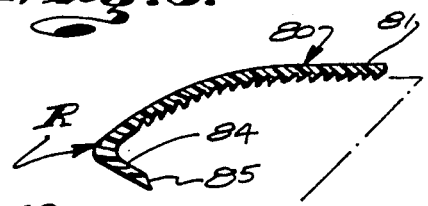
FIG. 3 is an exploded view of the door frame shield.

In practice, the rear edge portion of the web 61 of the part 50 is formed to turn rearwardly and outwardly and thence slightly forwardly (approximately 105°) as shown in FIG. 3 of the drawings. Forming the web as noted above enhances its ability to yield into confirmation with its related portion of a door frame and works to impart the whole of the door frame shield with a desireable door frame clamping or gripping action.

The front section 70 of the inner assembly A includes a longitudinally extending forwardly and outwardly turned or curved flexible front web part 71; a longitudinally extending rear tongue part 72 along and projecting rearwardly from the web part 71 and an elongate longitudinally extending front gripper part 73 at and along the forward outer edge of the webbed part 71.

The web 71 is normally recurvant to extend forwardly from the tongue part, and thence outwardly and rearwardly through about 105°. When in use, the web 71 extends about the corner defined by the forward edge portion of the jamb 17 and/or the inside edge portion of the front casing 30, to engage and be supported by the front portion of the front surface 31 of the casing 30.

The tongue 72 is flat and has a flat inside surface 74 and an outside surface 75. The surface 75 is formed with longitudinal serrations or teeth with rearwardly and outwardly inclined ramp surfaces and rearwardly disposed stop surfaces. In use, the tongue 72 is slid rearwardly into engagement in the slot in the inner gripper part 55 of the section 50 until the web 71 and gripper 73 are drawn into tight secure engagement with the front casing 30. As the tongue 72 is urged rearwardly into the gripper 55 the opposing teeth of the gripper 55 and tongue 72 ride over each other progressively until the parts reach their desired set position whereupon the teeth establish interengaged relationship with each other and the tongue 72 cannot be drawn forwardly from engagement in the gripper 55.

It is to be particularly noted at this time that the tongue 72 is great enough in fore and aft extent or width so that the shield can be made to properly and effectively engage standard door frames having the greatest distance between their stop 25 and the front surface of their front casings 30.

Figure 5:
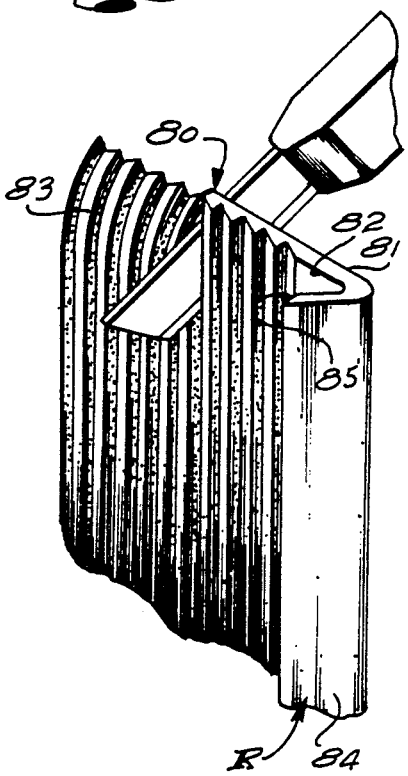
FIG. 5 is an isometric view illustrating the manner in which part of the door frame shield can be trimmed; and, FIG. 6 is a fragmentary isometric view showing parts of the door frame shield being disengaged.

If the tongue 72 is too wide and is likely to bottom out in the gripper 55 before the parts are properly set, the rear edge portion of the tongue 72 can be trimmed off to an appropriate width by drawing a sharp blade longitudinally along an appropriate tooth on the tongue, as clearly illustrated in FIG. 5 of the drawings. It is to be noted that the teeth establish blade guiding grooves that enable one of ordinary skill to accurately and quickly trim the tongue, leaving it with a straight clean rear edge.

The front gripper 72 of the section 70 is the same as the rear gripper 64 of the section 50.

The two like retainers R and R′ are related to the sections 50 and 70 of the inner assembly A and the front and rear casings 30 and 31 of the frame F. Each retainer includes an elongate vertically extending inner tongue 80 that is coextensive with the assembly A. Each tongue 80 has oppositely disposed interior and exterior surfaces 80 and 81. The interior surfaces of the tongues 80 are formed with longitudinal serrations or teeth 83 with ramp and stop surfaces similar to the teeth in the gripper parts 62 and 73 of the inner assembly A.

The retainers R and R′ next include longitudinally extending outer retainer flanges or cleats 84 on the outer edge portions of the tongues 80. The cleats overlie and engage the outer edges 33 and 36 of their related casings 30 and 31. The flange-like cleats 84 are angularly related to the tongues 80 to project inwardly from the interior surfaces of the tongues and to define inwardly disposed edges 85 that oppose the outer edges 33 and 36 of their related casings 30 and 31, as clearly shown in the drawings.

In practice and as shown in FIG. 3 of the drawings, the retainers R and R′ are preferably bowed in cross-section and prestressed so that when they are in use their outer end portions establish yielding bearing engagement on the outer portions of the casings and hold the cleats engaged with the outer edges of the casings.

When in use and after the sections 50 and 70 of the central assembly A have been engaged with each other and with the door frame as noted above, the tongues of the retainers R and R′ are entered into their related gripper parts 70 and 72 and are urged inwardly therein, drawing the sections 50 and 70 of the inner assembly outwardly and into close tight engagement with their related parts and portions of the frame F and until the cleats establish tight secure engagement with their related outer edges of their related casings. When so set, the interengaged teeth of the several gripper parts and tongues prevent the assembled shield from becoming loose and prevent it from becoming displaced from its related door frame during normal anticipated use of the shields.

It is to be noted that the tongue parts of the retainers R and R′, like the tongue 72 of the part 70 can be easily and quickly trimmed in the manner illustrated in FIG. 5 of the drawings to adapt the shield for engagement with different sizes of door frames. It will be noted that in FIG. 4 of the drawings the tongues of the retainers have been trimmed and are notably less extensive than the tongues of the retainers in FIG. 2 of the drawings.

It is also to be noted that the slot in the inside gripper 55 of the subassembly A is of considerable depth and its related tongue is of great width (fore and aft) whereby great front to rear adjustment of the sections 50 and 70 is attainable before trimming of the tongue 72 might be required.

The slots in the grippers 62 and 73 are of such depth that their related tongues need only enter a small portion thereof to attain an effective coupling of the parts. Accordingly, when it is necessary to trim the tongues sufficiently great tolerances are afforded so that one having ordinary skills and equipped with no more than a razor blade or pocket knife can effectively trim the tongues, as circumstances might require.

When the shield is engaged with a door frame F, the interior walls of the several grippers, which are formed with the serrations or teeth, engage with and are supported by their related parts and portions of the frame structure and are not subject to being lifted or otherwise displaced from their set positions on and against the frame structure. The other or exterior walls of the grippers serve to hold and retain the tongues engaged with the interior walls with the teeth or serrations of the walls and tongues in interengaged relationship and also serve to shield the edges of the tongues so that they are not likely to be engaged and bent or otherwise moved from their desired set position.

It is to be noted that the shield is closely engaged about its related door frame and is free of any substantial part or portion that is loose, unsupported and such that it might be moved and displaced if impacted or otherwise engaged by foreign objects in the normal course of its use.

When it is desired to remove the shield, the cleat of one of the retainers is pried from engagement with its related casing and the entire shield can be easily pulled away and from engagement with the frame F. Once free from the door frame, the several parts of the shield can be disassembled by pulling or drawing the tongues longitudinally out of engagement with their related grippers, as illustrated in FIG. 6 of the drawings.

It is to be noted that the normal or standard clearance between the inside surface 19 of a standard door frame and its opposing edge of a related door is 3/32". Accordingly, the web part 61 of the shield can be at least 2/32" or 1/16" thick. The standard space between the rear edge of the door stop and the front surface of a door engaged in a standard door frame is 1/16". Accordingly, the front wall 53 of the channel part 51 can be 1/16" thick. The noted web part 61 and front wall 53 noted above are the only parts of the shield that must be established and maintained thin to make the shield adaptable for engagement with a standard door frame. All other parts and/or portions of the shield can be made thicker and heavier than the noted web and front wall without adverse effects.

In accordance with the foregoing, if desired, the thickness of the tongues of the shield can be made thicker so that both surfaces or sides therof can be serrated and both of the inside opposing surfaces in the gripper parts can be serrated so that the several related parts are more securely held together.

It will be apparent from the foregoing that the sections of the inside assembly A and the retainers R and R' are such that they can be advantageously extruded of any suitable plastic material. But for the web part 61 and the rear wall 54 of the section 50, the wall thickness of all of the parts and portions of the shield can be adjusted to enhance the manufacture and most effectively utilize the physical characteristics of the particular plastic material used to establish the shield structure. For example, when making the shield of a soft resilient plastic material, the wall thickness of those parts and portions of the shield that can be increased might advantageously be made substantially thicker than the corresponding walls of a shield made of a harder and less flexible plastic material.

Having described only one typical preferred form and application of my invention, I do not wish to be limited to the specific details herein set forth but wish to reserve to myself any modifications and/or variations of the invention that may be apparent to those skilled in the art.

Having described my invention, I claim:

1. A door frame shield comprising an elongate inside assembly including a longitudinally extending front section with front and rear edges and a rear section with front and rear edges; elongate front and rear retainers with inside and outside edges; the front edge of the rear section is formed with a longitudinally extending forwardly opening inner slot, the rear edge of the front section is formed with a longitudinally extending inner tongue, the tongue of the front section is moved rearwardly into retained engagement in the slot of the rear section, the front edge of the front section and rear edge of the rear section are formed with longitudinally extending outwardly opening outside slots and the inside edges of the front and rear sections are formed with longitudinally extending outside tongues moved into retained engagement in the outwardly opening slots of the front and rear sections, the rear edge of the front and rear retainers are formed with longitudinally extending cleats, the sections of the inside assembly substantially conform with inwardly, forwardly and rearwardly disposed surfaces of a related jamb and door stop of a door frame structure and extend outwardly to front and rear surfaces of front and rear casings of the door frame structure, the cleats of the retainer overlie an established stopped engagement with outside surfaces of the front and rear casings.

2. The door frame shield set forth in claim 1 wherein the rear section of the inside assembly is formed with a longitudinally extending inwardly projecting and outwardly opening channel with inside, front and rear walls that engage about inside, front and rear surfaces of the door stop, a web extending rearwardly from the rear wall in flat supported engagement on an inside surface of the jamb rearward of the door stop, the wall thickness of the rear wall and the web are no greater than the standard clearance between the rear surface of the door stop and inside surface of the door jamb and the front surface and outside edge of a door hingedly hung within the door frame structure to pivotally swing into and out of stopped closed engagement with the rear surface of the door stop.

3. The door frame shield set forth in claim 2 wherein the inner slot and inner tongue are shiftable relative to each other to move the sections of the inside assembly into cooperatively engage the jamb and door stop assemblies of door frames having different dimensions.

4. The door frame shield set forth in claim 3 wherein the slots and tongues have opposing longitudinally extending parallel serrations that allow movement of the tongues into engagement in the slots and stop movement of the tongues out of the slots.

5. The door frame shield set forth in claim 2 wherein the related outside slots and outside tongues are shiftable relative to each other to move the retainers relative to the inside assembly to cooperatively engage the casings of door frames having different dimensions.

6. The door frame shield set forth in claim 5 wherein the slots and tongues have longitudinally extending parallel serrations that allow movement of the tongues into engagement in the slots and stop movement of the tongues out of the slots.

7. The door frame shield set forth in claim 2 wherein the inside and outside slots and their related inside and outside tongues are shiftable relative to each other to make the shield cooperatively engage door frame structures having different dimensions.

8. The door frame shield set forth in claim 7 wherein the slots and tongues have opposing longitudinally extending parallel serrations that allow movement of the tongues into engagement in the slots and stop movement of the tongues out of the slots.

9. A door frame shield engageable about the inside surface and the front and rear edges of a related standard door frame jamb, the inside surface and front and rear edges of a related standard door stop projecting inward from the inside surface of the jamb between the front and rear edges thereof and outwardly about the front and rear surfaces and the inside and outside edges of front and rear casings extending outward from the front and rear edges of the jamb; the shield includes an inside assembly comprising an elongate front section with a longitudinally extending outwardly opening channel part with an inside wall and front and rear walls to engage the inside surface and the front and rear edges of the door stop, a thin flexible rear web part extending rearwardly from the rear wall of the channel part adjacent the inside surface of the jamb and thence outwardly to the rear surface of the rear casing, a rear gripper part with a longitudinally extending rearwardly opening slot with at least one longitudinally serrated surface on the web and adjacent the rear surface of the rear casing and an inner gripper part projecting forward from the front wall of the channel part and adjacent the inside surface of the jamb and having a forwardly opening longitudinally extending slot with at least one longitudinally serrated surface; an elongate front section with a longitudinally extending inner tongue part with at least one longitudinally serrated surface and entered into the slot in the inner gripper part and projecting forwardly therefrom adjacent the front surface of the jamb and a flexible front web part projecting forwardly and outwardly from the inner tongue part to the front surface of the front casing and a front gripper part with an outwardly opening longitudinal slot with at least one longitudinally serrated surface on the front web part and adjacent the front surface of the front casing; a front retainer with a longitudinally extending tongue with at least one longitudinally serrated surface engaged in and projecting outward from the slot in the front gripper part and a rearwardly projecting cleat at an outer edge of the front tongue overlying and in stopped engagement with the outside edge of the front gripper part; and a rear retainer with an elongate tongue part with at least one longitudinally serrated surface engaged in and projecting outwardly from the slot in the rear gripper part and a forwardly projecting cleat at the outer edge of the rear tongue overlying and in stopped engagement with the outside edge of the rear casing; the longitudinal serrations on the surfaces of the tongue parts and in the gripper parts allow movement of the tongue parts into the gripper parts and interengage to stop movement of the tongue parts from engagement in the gripper parts.

* * * * *